US008181835B2

(12) United States Patent
Thatcher

(10) Patent No.: US 8,181,835 B2
(45) Date of Patent: May 22, 2012

(54) RESILIENT STRAP MOUNTING FOR USER-BORNE ATHLETIC PACKS

(75) Inventor: Bryce Thatcher, Sugar City, ID (US)

(73) Assignee: Penguin Brands, Inc., Sharon Hill, PA (US)

( * ) Notice: Subject to any disclaimer, the term of this patent is extended or adjusted under 35 U.S.C. 154(b) by 866 days.

(21) Appl. No.: 11/698,002

(22) Filed: Jan. 25, 2007

(65) Prior Publication Data

US 2008/0179364 A1 Jul. 31, 2008

(51) Int. Cl.
*A45F 3/14* (2006.01)

(52) U.S. Cl. ..... 224/631; 224/627

(58) Field of Classification Search ..... 224/153, 224/257, 259, 578, 600, 627, 628, 631, 644, 224/645, 579, 640, 641
See application file for complete search history.

(56) References Cited

U.S. PATENT DOCUMENTS

| | | | | |
|---|---|---|---|---|
| 5,199,621 | A * | 4/1993 | McLennan | 224/288 |
| 5,617,984 | A | 4/1997 | Fabel | |
| 6,006,974 | A * | 12/1999 | Varney et al. | 224/645 |
| 6,053,381 | A | 4/2000 | Fahl et al. | |
| 6,070,776 | A | 6/2000 | Furnary et al. | |
| 6,079,602 | A | 6/2000 | Howell | |
| 6,460,746 | B1 | 10/2002 | Amram | |
| 6,687,963 | B1 * | 2/2004 | Chang | 24/579.11 |
| 6,722,543 | B1 | 4/2004 | Fitzgerald et al. | |
| 6,802,442 | B1 | 10/2004 | Thompson | |
| 6,840,419 | B2 | 1/2005 | Penny et al. | |
| 6,871,766 | B2 | 3/2005 | Nordstrom | |
| 6,889,882 | B1 | 5/2005 | Leep | |
| 6,892,915 | B2 | 5/2005 | Mares | |
| 7,028,873 | B1 | 4/2006 | Collier et al. | |
| 7,537,143 | B1 * | 5/2009 | Collier | 224/633 |
| 2005/0092803 | A1 * | 5/2005 | Collier | 224/631 |

* cited by examiner

*Primary Examiner* — Justin Larson
*Assistant Examiner* — Adam Waggenspack
(74) *Attorney, Agent, or Firm* — John J. Skinner, Jr.; Michelman & Robinson, LLP

(57) ABSTRACT

A resilient strap mount allowing for increased flexibility and movement of a user's shoulders and arms while wearing an athletic pack is presented. The resilient strap mount is constructed having a flexible body member consisting of two body member arms and a body member base. Shoulder harness straps, attaching to shoulder harnesses of the athletic pack, are each respectively threaded through one of the body member arms. An athletic pack strap, attaching to the base of the body of the athletic pack, is threaded through the body member base. In a preferred embodiment, each body member arm is constructed with a body member neck having a thinner width and thickness than the remainder of the flexible body member and each member neck has a pair of slot holes to allow for increased flexibility and stretching of the resilient strap mount.

9 Claims, 4 Drawing Sheets

RESILIENT STRAP MOUNTING FOR USER-BORNE ATHLETIC PACKS

FIELD OF THE INVENTION

The present invention is generally directed to a resilient strap mounting for a user-borne athletic pack, and more particularly, to a resilient flexible propulsion strap harness to assist movement and flexibility of a user wearing an athletic pack.

BACKGROUND OF THE INVENTION

A backpack is, in its simplest form, a cloth sack carried on one's back and secured with two straps that go over the shoulders and below the armpits. Backpacks are often preferred to handbags for carrying heavy loads for long periods of time, because the shoulders are better suited for bearing heavy weights for long periods of time than the hands are. Backpacks, also referred to as packs, typically stand about 3 feet (1 m) tall; and have a content between 60 and 100 liters.

Packs essentially come in two main types: externally framed and internally framed. The external frame, the more traditional of the two, uses a rigid frame which is strapped on the back and in turn carries and supports a cloth sack and potential strapped on items. Wooden pack frames have been used for centuries around the world, and metal versions first appeared in the mid-20th century. Modern pack frames are usually made from lightweight aluminum tubes.

The external frame typically has a system of straps and pads to keep the sack and the frame from contacting the body. The open structure has the added benefit of improved ventilation and decreased sweatiness. The fabric part of the pack occupies part of the frame's length, but the frame typically protrudes above and below. These areas of the frame allow bulky items (such tents, sleeping bags, and thermal pads) to be strapped on. Thus the main compartment is smaller than that of an internal-frame pack, because bulky items (tents, sleeping bags, thermal pads) are strapped to the parts of the frame not occupied by the main compartment itself.

The internal-frame pack, on the other hand, has a large cloth part in which a small frame is integrated. This frame can consist of strips of either a metal or specially designed polymer that molds to one's back to provide a good fit. Usually a complex series of straps works with the frame to distribute the weight and hold it in place. Internal-frame packs may provide a few lash points, but as the frame is fully integrated and not available on the outside, it is difficult to lash a large, heavy item so that it stays fixed and does not bounce, so most cargo must fit inside.

Internal-frame packs originally suffered from smaller load capacity and less comfortable fit during steady walking, but newer models have improved greatly in these respects. In addition, because of their snug fit, they ride better in activities that involve upper-body movement; such as scrambling over rocky surfaces. The improved internal frame models have largely replaced external frame backpacks. In Europe hardly any external-frame models are sold anymore, but in the United States, some manufacturers continue to produce them.

Large backpacks, used to carry loads over 10 kg, usually offload the largest part (up to about 90%) of their weight onto padded hip belts; leaving the shoulder straps mainly for stabilizing the load. This improves the potential to carry heavy loads, because the hips are even stronger than the shoulders, and increases agility and balance, because the load rides nearer the person's own center of mass.

However, both athletic backpacks and packs with hip belts do not account for some movement required by certain activities. In other words, such packs can be limiting on the flexibility and movement of the pack wearer, or even in the extreme, restrictive of movement.

SUMMARY OF THE INVENTION

Accordingly, the present invention is directed to a resilient strap mounting for mounting of shoulder harness straps to a user-borne athletic pack. The resilient strap mounting allows the flexibility and improved motion of the user while wearing the athletic pack through a flexible body member.

In a preferred embodiment of the resilient strap mounting flexible body member, the body member is constructed having two body member arms and a body member base through which two shoulder harness straps and one athletic pack strap are, respectively, routed. Routing of the two shoulder harness straps and athletic pack strap through the respective neck and base of the flexible body member is by means of slot holes cut through the two arms and base.

In an alternative embodiment, each of the body member arms is constructed having a body member neck, which assists in the flexibility and resiliency of the flexible body member. Each neck is narrower than the end of the body member arm allowing for additional stretching of the body member arm when required.

The embodiments allow for user shoulder and arm movement without significant displacement of the athletic pack on the back. This occurs through the resilient flexing of the strap mounting in response to the movement of the athletic pack user's shoulders and arms.

The present invention, including its features and advantages, will become more apparent from the following detailed description with reference to the accompanying drawings.

DETAILED DESCRIPTION

FIGS. 1 through 4 show various embodiments of the resilient strap mount for a user-borne athletic pack which allows for increased movement and flexibility of a pack user's shoulders and arms during wear of the athletic pack. The resilient strap mount is constructed in various embodiments to be both flexible and resilient such that it allows for flexing and distortion of its shape and then return (i.e., through resilience) to its original shape.

Figure 1:
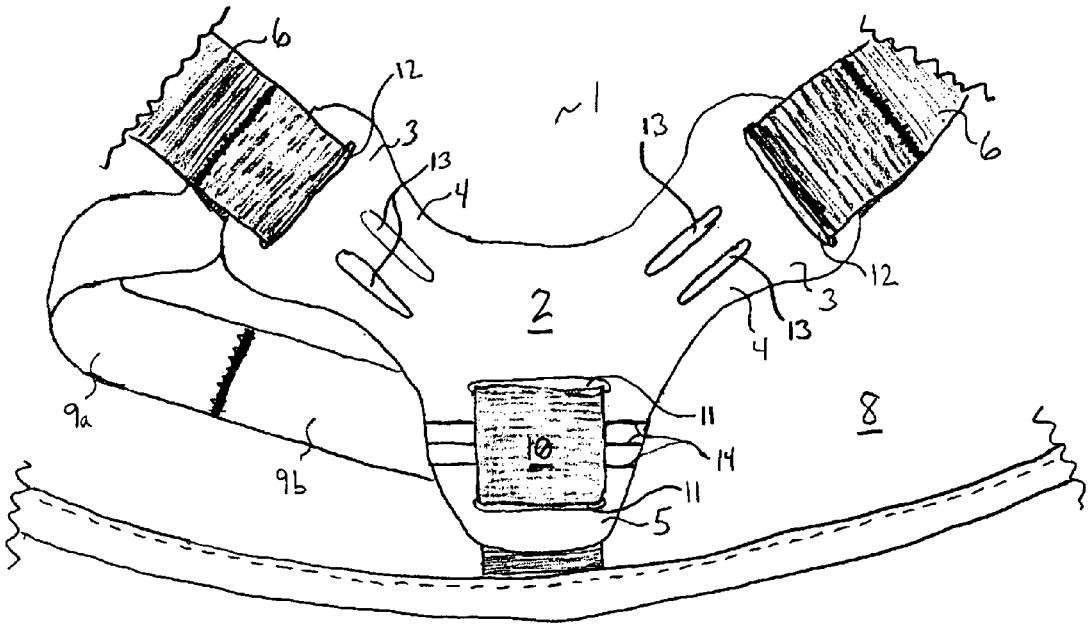
FIG. 1 is an illustration of a plan view of the resilient strap mount, according to an embodiment of the present invention.

Referring now to FIG. 1, a plan view of a resilient strap mount 1 is shown. The resilient strap mount 1 is constructed having a flexible body member 2. The flexible body member 2 is preferably constructed of a thermal plastic elastic, also known as a TPE, such that at both high and low temperatures it is flexible when biased while returning to its original shape when the biasing ceases. It is to be understood, of course, that the flexible body member 2 may be constructed of any flexible and resilient (durable) material.

In a preferred embodiment, the flexible body member 2 is constructed having two body member arms 3 to which shoulder harness straps can be attached. Each body member arm 3 is preferably constructed at approximately a 45° angle from a vertical axis of the resilient strap mount 1. It is to be understood, of course, that such preferred angling of the body member arms is not to be considered limiting and that other angles are to be considered as within the scope of the current invention. Such angling may be different based on any number of factors to include, for instance, the overall shape of the pack or the placement and/or angling of the shoulder straps to be attached to the body member.

Each body member arm 3 is further preferably constructed to have a body member neck 4. Each body member neck 4 is constructed having a narrower width and thickness than that found in the center of the flexible body member 2 or at the ends of the body member arm 3. In other words, the outside circumferential dimension of the member neck 4 tapers along a vertical axis to have a thinner width and thickness at a center perpendicular axis point of the body member neck 4. Such thinning in both width and thickness allows for the majority of the stretching and flexibility of the resilient strap mount 1 to occur at the neck 4. Such tapering construction allows for approximately two inches of additional flex.

In addition, in a further preferred embodiment, the body member neck 4 may have at least one member neck slot hole 13 cut through it. Such slot holes allows for additional flexibility without the neck loosing tensile strength and for control of such flexing so that it is even across the neck. Preferably, the body member neck 4 is constructed having two member neck slot holes 13 each running parallel to the other along a vertical axis of the neck. It is to be noted that with the parallel running of the two slot holes 13 a middle piece of the neck is created. Such middle piece aids in control of the flexibility of the neck 4.

Each body member arm 3 is additionally constructed to have a shoulder harness strap slot hole 12 cut there through towards the tip of the body member arm. The strap slot hole 12 is cut such that it's length is perpendicular to the vertical axis of the body member neck 4 and the member neck slot holes 13 cut there through. The shoulder harness strap slot hole 12 is cut enough of a distance from the end of the member arm 3 to ensure material strength remains and prevent tearing.

In a further preferred embodiment, the flexible body member 2 is also constructed having a body member base 5. The body member base 5 has two pack strap holes 11 cut there through. Each pack strap slot hole 11 is cut horizontally to the bottom of the base 5, and each is parallel to the other. In an embodiment of the base 5, the base 5 is constructed having a number of supporting ridges 14 integrally formed thereto. The supporting ridges 14 give additional tensile strength to the material of the base 5.

Figure 2:
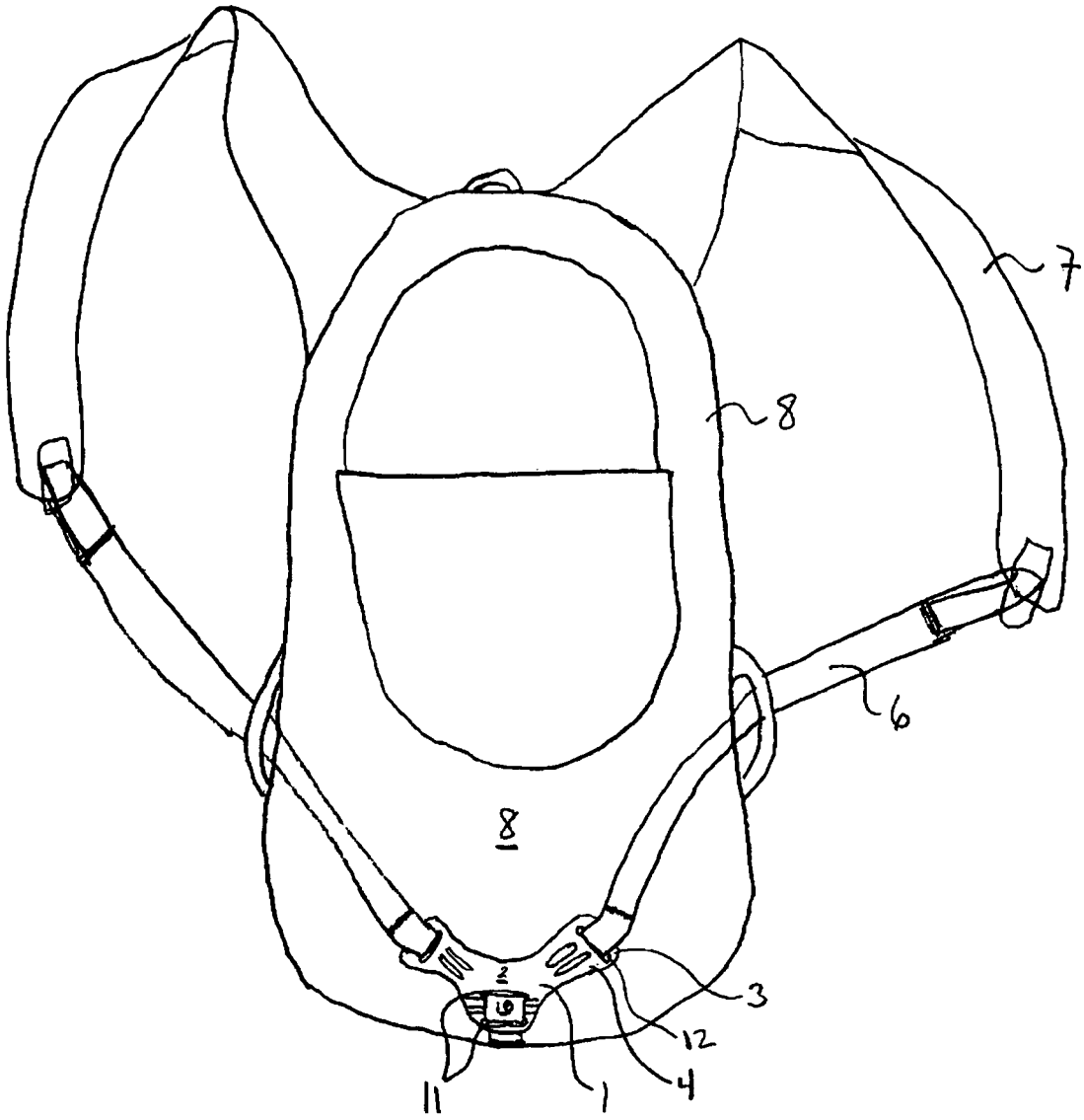
FIG. 2 is an illustration of a plan view looking down at the front of a backpack, according to an embodiment of the present invention.

Referring now to FIG. 2, the resilient strap mount 1 is mounted on the athletic pack 8 via shoulder harness strap 6 and athletic pack strap 10. As can be seen in the figure, the shoulder harness strap 6 attaches at an end away from the resilient strap mount 1 to the shoulder harness 7 integrally connected to the pack 8. At the end closest to the resilient strap mount 1, the shoulder harness strap 6 is fitted through shoulder harness strap slot hole 12 and then doubles back upon itself. It is securely fastened to itself via well-known stitching techniques. Likewise as can be seen in the figure, the athletic pack strap 10 is threaded through each of the pack strap slot holes 11. The ends of the pack strap 10 are then securely fastened to the athletic pack 8 via well-known stitching techniques.

Accordingly, when either the left or right shoulder harness is pulled, by movement of the pack user's arm or shoulder movement, the respective shoulder harness strap 6 pulls on the respective body member arm 3. The flexibility of the flexible body member 2 overall and the body member neck 4 in particular allows for stretching of the respective body member arm 3 in the direction of the pull of the shoulder harness strap 6. This then affords the pack user additional movement flexibility without noticeable movement of the pack from its original position on the user's back. Upon the end of the pack user's arm or shoulder movement, the resiliency of the flexible body member and body member neck returns the resilient strap mount 1 to its original shape.

It will be noted that the construction of the preferred embodiment of the present invention of the flexible body member 2, that is a construction consisting of two body member arms 3 and a body member base 5, allows for a "three-way" stretch of the resilient strap mount 1. This then allows for greater freedom of movement by the user in that the user can move each shoulder and arm at the same time and also bend forward, all without disruption of the placement of the pack on the user's back.

It is to be understood, of course, that "two-way", "four-way" and other geometrical stretches of the resilient strap mount 1 may be accomplished by changing of the construction of the flexible body member 2. For instance, a "two-way" stretch may be accomplished by constructing the flexible body member such that the base 5 is not as separately pronounced from the center of body member 2 while at the same time the angling of the body member arms is such that they are more diametrically opposed (e.g., up to a full 90° angle from a vertical axis of the resilient strap mount 1). Such construction would thus take the overall shape of an "T", but having a short vertical part. A "four-way" stretch may be accomplished by constructing the flexible body member such that there are two bases 5, each directed downwards at a 45° angle from a vertical axis of the flexible body member, and two member arms 3, each at directed upwards at a 45° angle from a vertical axis of the flexible body member. Such construction would thus take the overall shape of an "X". Attachment to the athletic pack of these various embodiments would take the same essential construction as disclosed for the "three-way" stretch.

Figure 3:
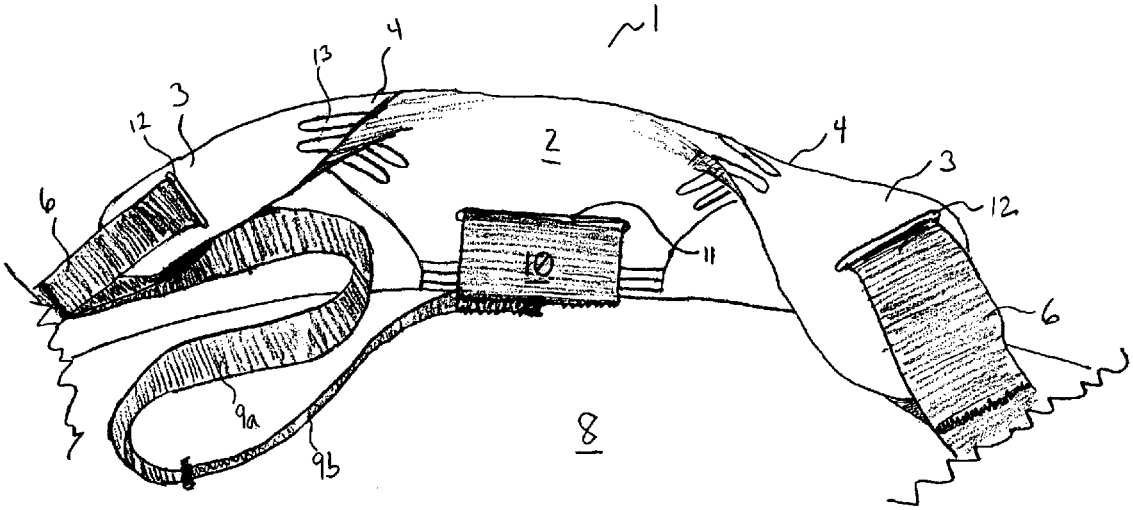
FIG. 3 is an illustration of a perspective view of the resilient strap mounting, according to an embodiment of the present invention.

Referring now to FIG. 3, a partial underside view of the resilient strap mount 1 is shown through the "lifting" of the top edge of the flexible body member 2 and resultant twisting of each of the body member necks 4. This then shows the increased flexibility afforded to the flexible body member 2 by the body member neck 4. The thickness of the flexible body member 2 can also be discerned from this figure. In an embodiment, the flexible body member 2 is approximately seven millimeters thick at the body member base 5 and at the end portions of the body member arms 3. The body member neck 4 is somewhat thinner, ranging in thickness from between four to six millimeters.

In addition, as can also be discerned from the figure, the athletic pack strap 10, fitted through the pack strap hole 11, is secured to the athletic pack 8 via well-known stitching techniques. Also in addition, as an alternate means of securing the resilient strap mount 1 to the athletic pack 8, a security strap 9 may be utilized. Such security strap is utilized to prevent the athletic pack from falling off the user's back should the resilient strap mount fail. In a preferred embodiment, midway along its length the security strap is secured to the athletic pack via stitching, thus causing the security strap to be effectively divided into two parts. The security strap portion 9*a* secures the shoulder harness strap 6, to which it is connected via stitching, to the athletic pack 8. The security strap portion 9*b* connects the athletic pack strap 10, to which it is connected via stitching, to the athletic pack 8. Preferably, a security strap 9 is connected respectively to each of the shoulder harness straps 6.

Figure 4:
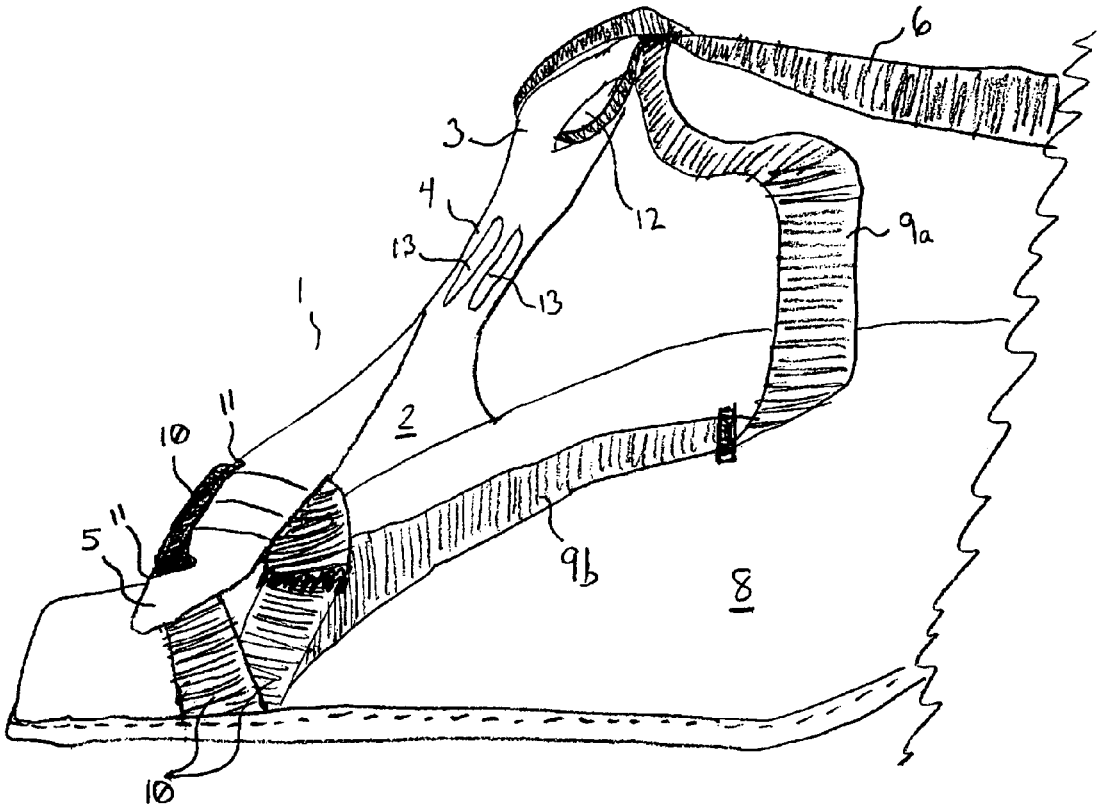
FIG. 4 is an illustration of a side perspective view of the resilient strap mounting, according to an embodiment of the present invention.

Referring now to FIG. 4, a partial underside view of the resilient strap mount 1 is shown from a side perspective with one body member arm 3 pulled up and away from the athletic pack 8 for easier viewing. As can be seen from the figure, the base 5 of the flexible body member 2 is secured to the athletic pack 8 via athletic pack strap 10 which is threaded through each of the pack's strap slot holes 11. Each end of the athletic pack strap 10 is then stitch threaded and attached to the bottom of the athletic pack 8. Security strap 9B is stitch threaded and attached to the bottom of the athletic pack strap 10 and is secured via stitching via athletic pack 8.

Shoulder harness strap 6 is threaded through the shoulder harness strap slot hole 12 and around the end of the body member arm 3 and is stitch threaded and thus securely fastened to itself. Security strap 9A securely fastened via stitching to the athletic pack and then, at an opposite end, securely stitched to the shoulder harness strap 6. As mentioned above, the purpose of the security strap 9 is to act as a security device should stress pressure be great enough on the flexible body member 2 to break it.

Thus, as can be seen from the foregoing, the construction and placement of the resilient strap mount allows for increased movement and flexibility of a pack user's shoulders, arms and back thereby allowing for less hindrance of wearing a pack during athletic movement. In addition the construction and placement of the resilient strap mount acts to retain the pack in place on the user's back during such increased flexibility and movement. Also in addition, the construction and placement of the resilient strap mount acts to compress the shape (silhouette) of the pack to conform it to the user's back.

In the foregoing description, the method and apparatus of the present invention have been described with reference to a specific example. It is to be understood and expected that variations in the principles of the method and apparatus herein disclosed may be made by one skilled in the art and it is intended that such modifications, changes, and substitutions are to be included within the scope of the present invention as set forth in the appended claims. The specification and the drawings are accordingly to be regarded in an illustrative rather than in a restrictive sense.

What is claimed is:

1. An athletic pack, comprising:

a sack, having a top end and a bottom end, for storing items;

at least one shoulder strap, having a top end and a bottom end and connected by the top end of the at least one shoulder strap to the sack at the top end of the sack;

at least one athletic pack strap, having two ends and connected by the two ends together at the bottom end of the sack;

a security strap, connected at a point along its length to the sack, and by a first part to the at least one shoulder strap and by a second part to the at least one athletic pack strap; and a resilient strap mount, comprising:

at least one body member arm, and a body member base;

wherein the bottom end of the at least one shoulder strap, away from the top end of the sack, is routed through the at least one body member arm and attached thereto, and wherein a loop formed between the two ends of the at least one athletic pack strap is routed through the body member base, wherein the resilient strap mount flexes when the at least one shoulder strap is moved.

2. The athletic pack according to claim 1, wherein the top end of the at least one shoulder strap further comprises:

a shoulder harness, to which the bottom end of the at least one shoulder strap is connected, for use over a wearer's shoulder.

3. The athletic pack according to claim 1, wherein the at least one body member arm further comprises:

a strap slot hole, through which the end of the at least one shoulder strap away from the top end of the sack is routed.

4. The athletic pack according to claim 1, wherein the at least one athletic pack strap is connected at the bottom end of the sack via well-known stitching techniques.

5. The athletic pack according to claim 1, wherein the resilient strap mount further comprises:

a flexible body member, which integrally connects the at least one body member arm and the body member base.

6. The athletic pack according to claim 1, wherein the at least one body member arm and the body member base are integrally connected.

7. The athletic pack according to claim 1, wherein the routing of the at least one shoulder strap and the at least one athletic pack strap through the resilient strap mount is by means of slot holes cut through the resilient strap mount.

8. The athletic pack according to claim 1, wherein the at least one body member arm further comprises:

a body member neck, wherein the body member neck is of a narrower diameter than the end of the at least one body member arm.

9. The athletic pack according to claim 8, wherein the body member neck further comprises:

at least one member neck slot hole.

* * * * *